United States Patent [19]

Hall

[11] Patent Number: 5,022,093

[45] Date of Patent: Jun. 11, 1991

[54] KITTEN MITTEN

[76] Inventor: Roger E. Hall, P.O. Box 1217, Elon College, N.C. 27244

[21] Appl. No.: 381,596

[22] Filed: Jul. 18, 1989

[51] Int. Cl.[5] ..... A41D 19/00

[52] U.S. Cl. ..... 2/158; 2/164

[58] Field of Search ..... 119/29, 29.5, 145; 15/227; 2/158, 167, 160, 16

[56] References Cited

U.S. PATENT DOCUMENTS

| | | | |
|---|---|---|---|
| 170,734 | 10/1953 | Wright | 15/227 X |
| 532,462 | 1/1895 | Humphrey | 15/227 |
| 1,117,077 | 11/1914 | Mooney | 2/16 |
| 2,411,926 | 12/1946 | Linick | 2/158 |
| 2,729,023 | 1/1956 | Lerner et al. | 128/878 X |
| 2,756,448 | 7/1956 | Werbe | 15/227 |
| 2,902,693 | 9/1959 | Wells, Jr. | 2/158 |
| 3,327,320 | 6/1967 | Forsyth | 2/158 |
| 4,287,608 | 9/1981 | Meyer | 2/16 |
| 4,330,887 | 5/1982 | White | 2/16 |

FOREIGN PATENT DOCUMENTS

| | | | |
|---|---|---|---|
| 231912 | 6/1959 | Australia | 15/227 |
| 2837539 | 3/1980 | Fed. Rep. of Germany | 119/29 |
| 1125136 | 10/1956 | France | 2/16 |
| 2470819 | 6/1981 | France | 2/16 |
| 388837 | 3/1933 | United Kingdom | 2/158 |

*Primary Examiner*—Werner H. Schroeder
*Assistant Examiner*—Sara M. Current
*Attorney, Agent, or Firm*—Ralph H. Dougherty

[57] ABSTRACT

The invention is a protective type mitten or glove for use as a toy with which to play with a kitten, cat, or similar sharp toothed and/or clawed animal (i.e., raccoon, ferret, etc.). The glove extends well up the forearm past the wrist, nearly to the elbow. The invention is provided with eyes and/or a nose that rattles. In addition, it has a protective material, such as heavy denim, leather, vinyl or the like, between the outer covering and the inner lining. Alternatively, if the protective inner material is sufficently protective to a hand and arm, the lining may be omitted.

11 Claims, 5 Drawing Sheets

KITTEN MITTEN

BACKGROUND OF THE INVENTION

1. Field of the Invention

The present invention generally relates to guards and protectors for limbs and, more particularly, is concerned with a covering for protecting a hand and arm while playing with or handling an animal.

2. Description of the Prior Art

The enjoyment that a pet can bring is well known. Also, studies have shown that people who spend time with their pets, playing with them, and stroking and caressing them, have lower blood pressures, and are generally less stressed. The pleasure enjoyed by both animal and animal owner or handler can quickly disappear, however, in the event the animal bites or scratches the owner. In addition, older persons, particularly those living alone, reportedly have better mental health, and often live longer, if they have a house pet such as a small animal. Unfortunately, older persons also tend to have slower reaction times and are therefore more susceptible to cuts and scratches. They also tend to heal slowly from cuts and scratches. Young persons, especially of pre-school age, often unintentionally irritate an animal, such as a cat, with resultant nip, bite or scratch. Although protective gear used in the training of attack dogs is well known, no prior art has been found that serves the dual purpose of a play toy for an animal and a protective device.

The present invention is a protective type mitten or glove for use as a toy with which to play with a kitten, cat, or similar sharp toothed and/or clawed animal (i.e., raccoon, ferret, etc.). The glove extends well up the forearm past the wrist, nearly to the elbow. The invention is marketed under the trademark KITTEN MITTEN TM. As used herein, the term "kitten mitten" means any protective type mitten or glove for use as a toy with which to play with or handle any sharp toothed and/or clawed animal.

The applicant is aware of the following U.S. Pat. Nos. concerning hand and arm protectors in general.

| U.S. Pat. No. | Inventor | Issue Date | Title |
|---|---|---|---|
| 3,902,196 | Reinfandt | Sept. 2, 1975 | CANINE TRAINING APPARATUS |
| 4,382,301 | Hightower, Jr. | May 10, 1983 | SNAKE PROOF CHAPS |
| D135,368 | Clark | Mar. 30, 1943 | MITTEN |
| D50,445 | Hincks | Mar. 13, 1917 | MITTEN |
| 3,327,320 | Forsyth | Jun. 27, 1967 | MITTEN FOR HOLDING AN INFANT |
| D240,941 | Casey, et al. | Aug. 10, 1976 | ELEPHANT PUPPET |
| 3,747,565 | Kellam | Jul. 24, 1973 | ARTICLE OF ANIMAL APPAREL |
| 2,862,208 | Castro | Dec. 2, 1958 | PROTECTIVE GLOVE |
| 4,004,295 | Byrnes, Sr. | Jan. 25, 1977 | PROTECTIVE GLOVE CONSTRUCTED OF FLEXIBLE STRANDS OF METAL WIRE AND FIBER YARN |
| 4,507,803 | Ryan et al. | Apr. 2, 1985 | RIDING MITTENS |
| 2,581,549 | McGaugh | Jan. 8, 1952 | REFLECTING SIGNAL GLOVE |

Reinfandt relates to a protective device for use by a trainer in training attack dogs for security purposes. The device is clearly not intended as a toy, but as a professional training tool.

Hightower, Jr., relates to leggings which are adapted to surround legs of the wearer, whereby they are protected from snake bites. This invention is also not intended to be used as a toy and, in addition, relates to lower extremity protection.

Clark and Hincks both disclose a design for a mitten, showing a kitten face on the exterior of the mitten. An elongated arm covering is not shown in either design. Casey, et al. relates to an elephant puppet.

The remaining references are generally related to mittens or gloves of various types, and are submitted for disclosure purposes, but are not seen to be particularly relevant to the present invention.

Forsyth relates to a device for helping hold an infant while it is being bathed.

Kellam relates to an article of animal apparel adapted to be worn by domesticated animals such as a cat to facilitate bathing.

Castro teaches gloves which are worn by industrial and agricultural workers for the protection of their hands from injuries. Means are provided by the Castro invention for protecting those parts of the hand which are vulnerable to a machete when it is swung against a stalk crop such as sugar cane, corn and the like.

Byrnes, Sr. teaches protective gloves especially constructed for use in meat processing or packing plants for protecting employees engaged in various operations in such plants, thus enabling such personnel to perform their duties more safely and effectively, and further provides a long lasting, lightweight and durable protective glove.

Ryan et al. relates to mittens used by equestrians, designed to correctly position the reins in the riders hands while providing warmth without excessive thickness or weight.

McGaugh relates to a glove having unique light reflecting characteristics, so that it can be used for traffic signals as well as a glove.

Applicant is unaware of any prior art that accomplishes the objects of the present invention. Consequently, a need exists for a kitten mitten which will result in reducing or eliminating bites and scratches associated with playing with an animal, and, additionally, increase playtime enjoyment for both the animal and the one playing with the animal.

SUMMARY OF THE INVENTION

The present invention is an innovative device for protecting a hand and arm while playing with an animal, which overcomes the problems and satisfies the needs previously considered.

A hand covering portion receives the hand and protects against animal inflicted related injuries. An elongated arm covering portion, connected to and extending from the hand covering portion, receives the arm and also protects against animal inflicted related injuries. The kitten mitten is provided with features that animate the mitten, such as eyes or a nose which include a rattling mechanism.

In summary, the invention encompasses a protective type mitten or glove for use as a toy with which to play with a kitten, cat, or similar sharp toothed and/or clawed animal (i.e., raccoon, ferret, etc.). The glove extends well up the forearm past the wrist, nearly to the elbow. The invention is similar to a hand puppet, with eyes and/or a nose that rattles. In addition, it has a protective material, such as heavy denim, leather, vinyl or the like, between the outer covering and the inner lining. Alternatively, if the protective inner material is sufficiently protective to a hand and arm, the lining may be omitted.

OBJECTS OF THE INVENTION

The principal object of the present invention is to provide protection against injury associated with playing with an animal, such as bites or scratches, particularly injuries to the elderly and to young children.

Another object of the invention is to provide a toy for a kitten, cat, or similar sharp toothed and/or clawed animal (i.e., raccoon, ferret, etc.).

Another object of the invention is to provide a protective device for use when spraying, dipping, or bathing an animal, or administering medicine to the animal.

Yet another object of the invention is to provide a device that can perform multiple functions, for example, as both a stand alone toy and as a puppet-like toy used in combination with a human hand.

BRIEF DESCRIPTION OF THE DRAWINGS

The foregoing and other objects will become more readily apparent by referring to the following detailed description and the appended drawings in which.

DESCRIPTION OF THE PREFERRED EMBODIMENTS

Figure 1:
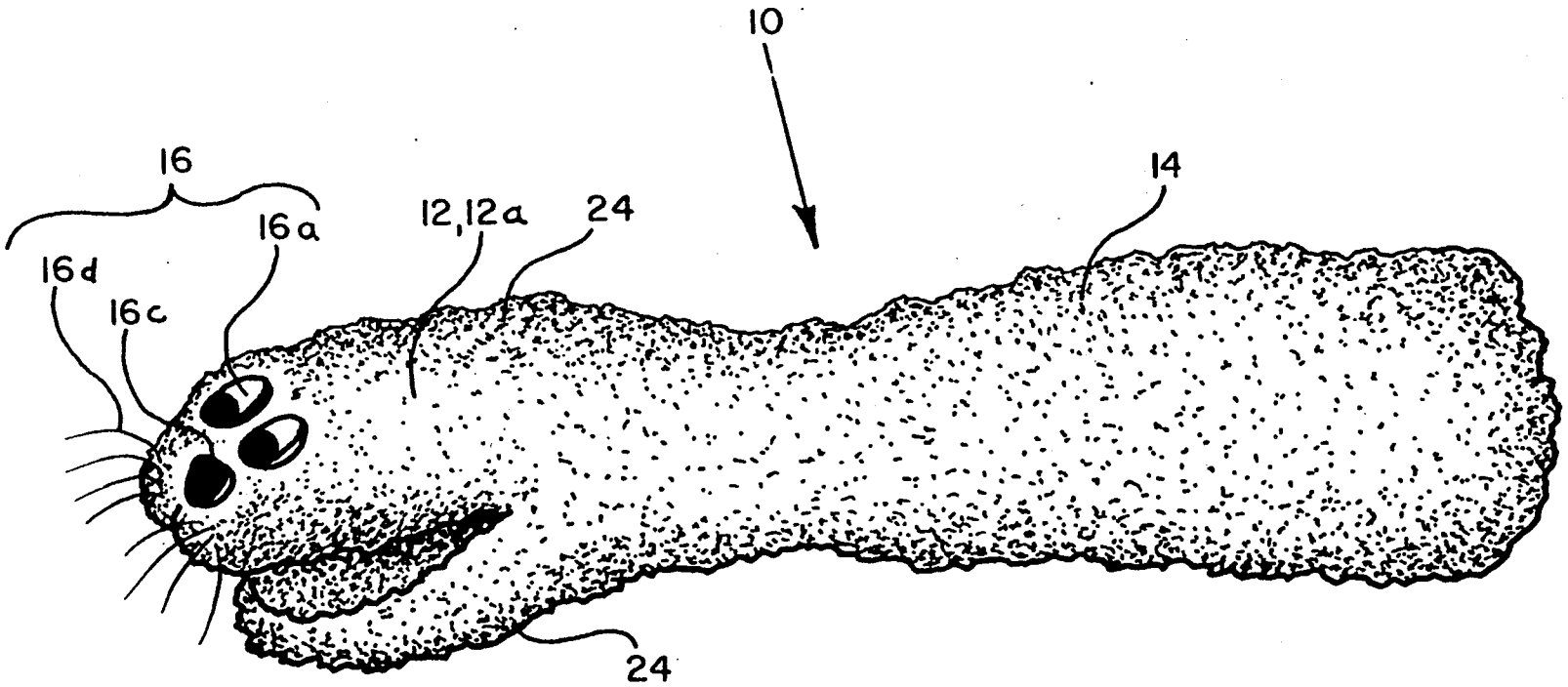
FIG. 1 is an isometric view of the preferred embodiment of the kitten mitten.
Figure 2:
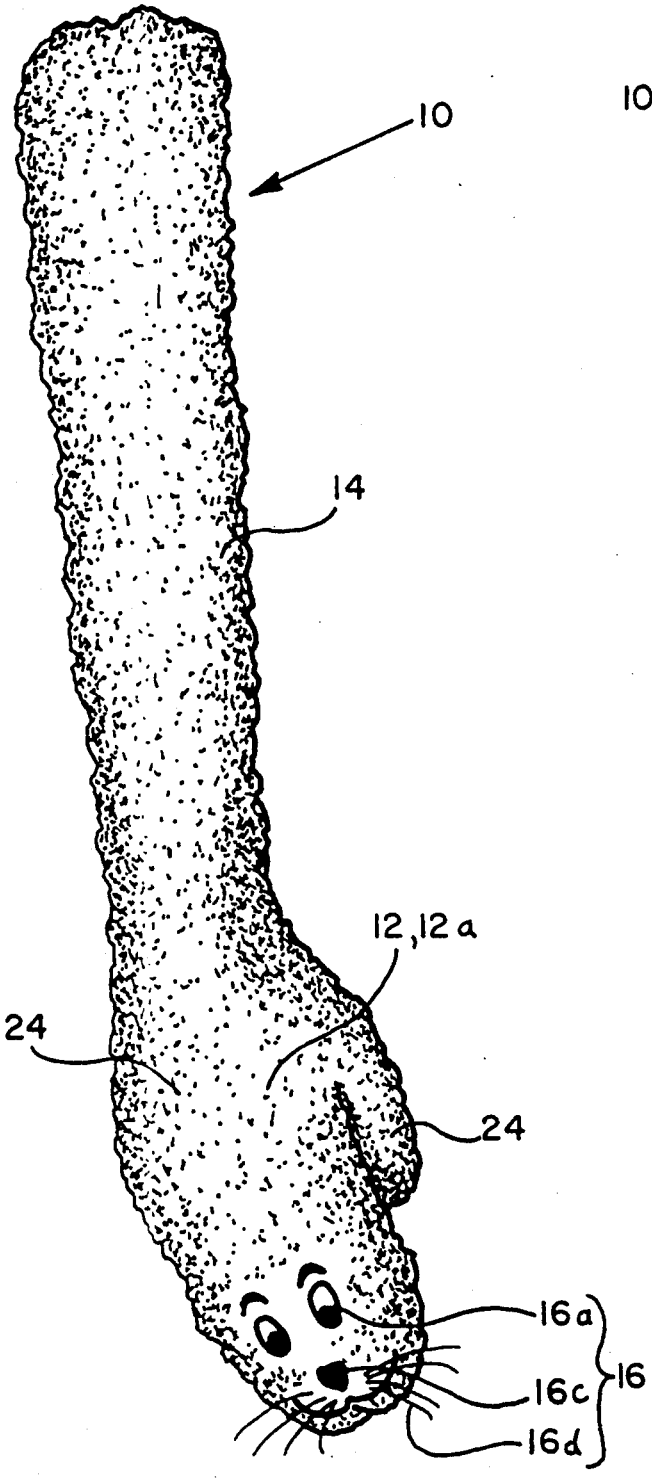
FIG. 2 is a plan view of the top of a right handed mitten version of the invention.
Figure 3:
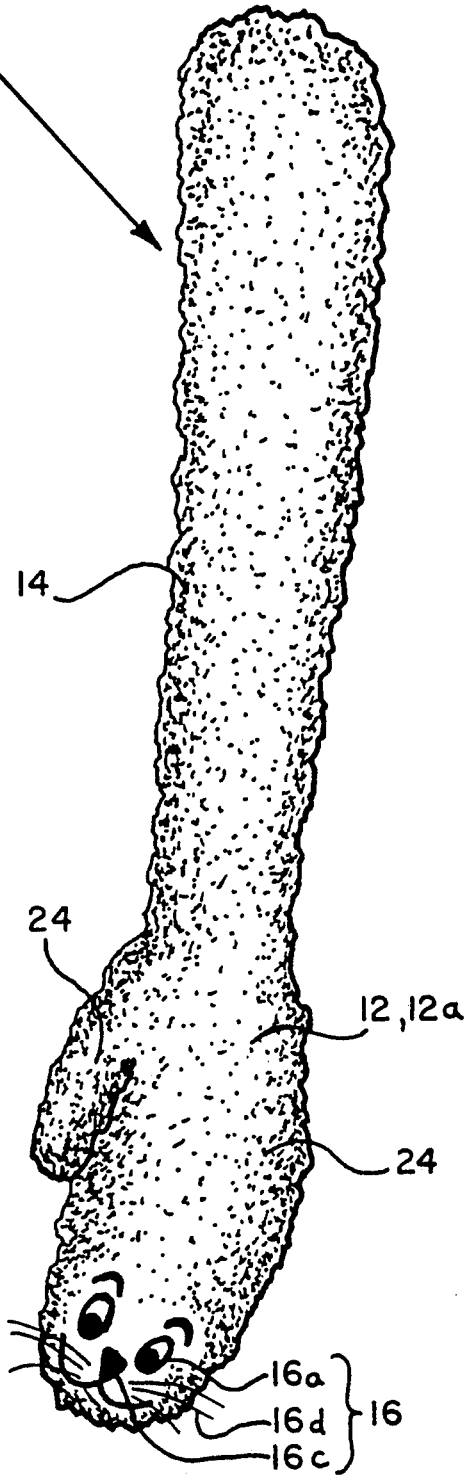
FIG. 3 is a plan view of the top of a left handed mitten version of the invention.

Referring now to the drawings, and more particularly, to FIG. 1, a kitten mitten, generally designated 10, comprises the preferred embodiment of the present invention.

Figure 4:
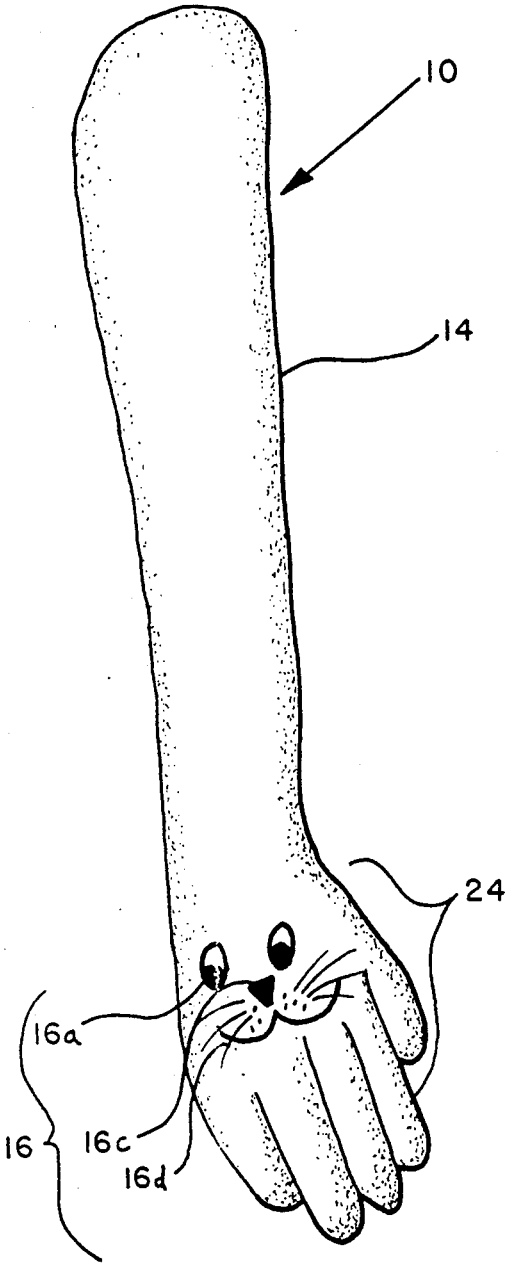
FIG. 4 is a plan view of the top of a right handed glove version of the invention.
Figure 5:
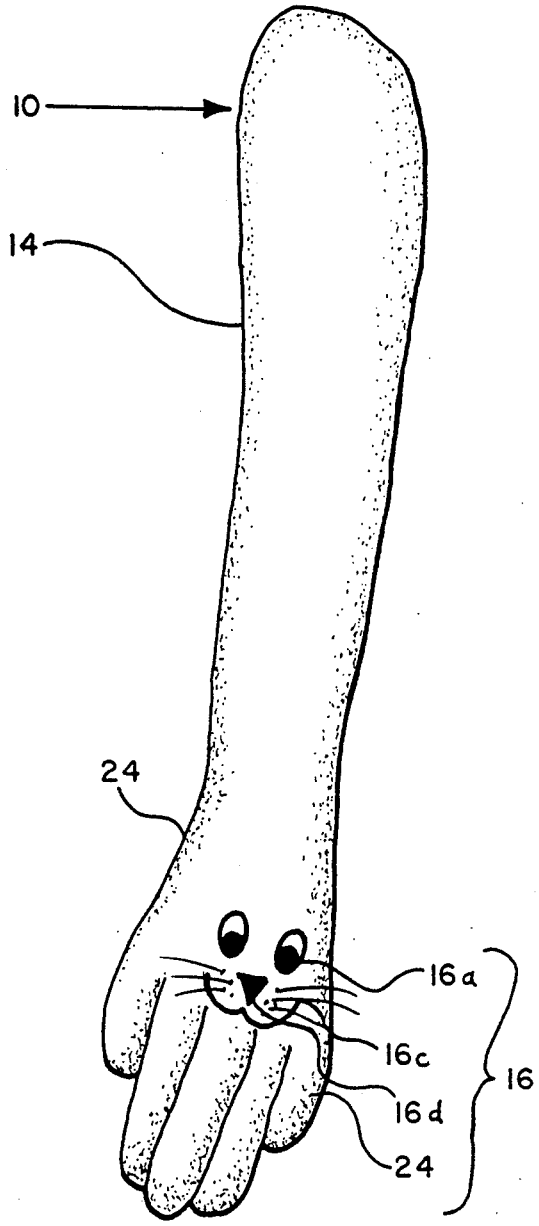
FIG. 5 is a plan view of the top of a left handed glove version of the invention.
Figure 7:
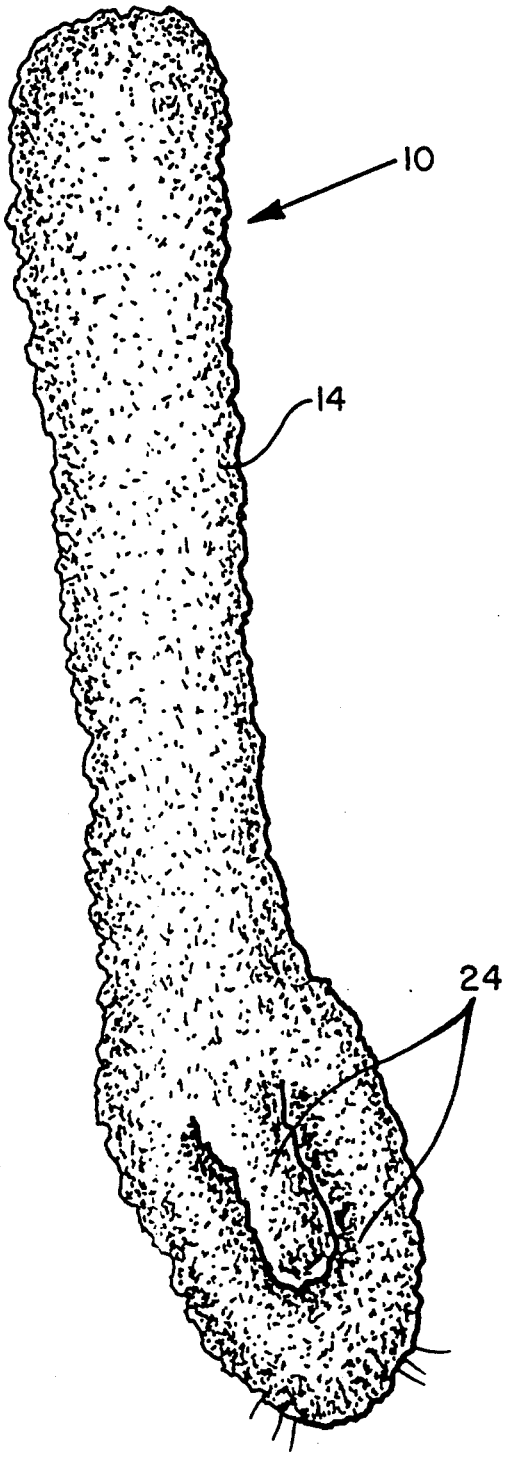
FIG. 7 is a plan view of the bottom of the mitten version of the invention shown in FIG. 6.
Figure 6:
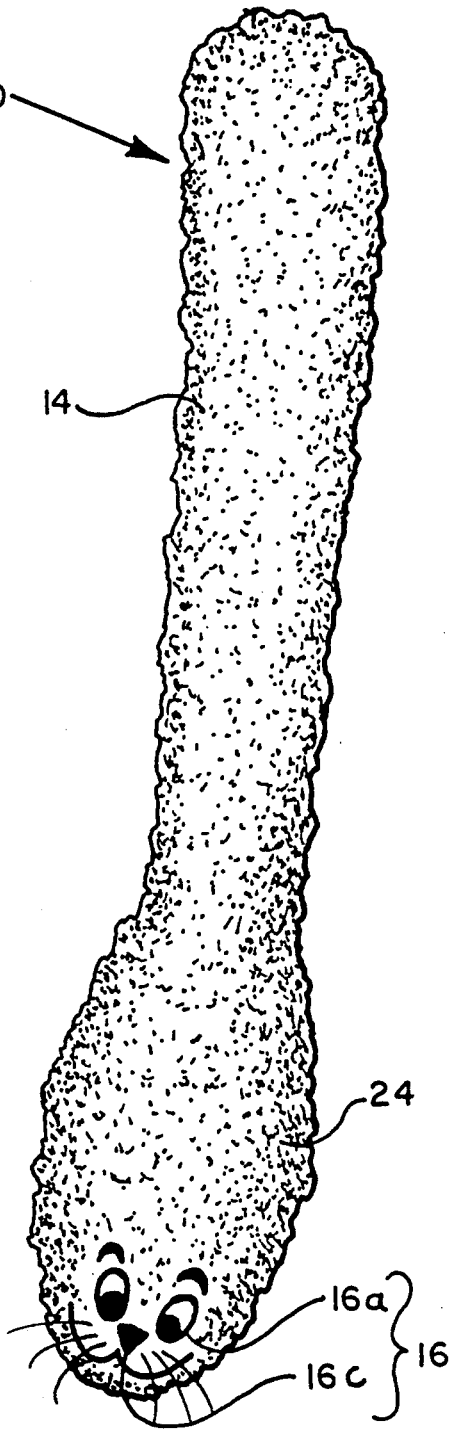
FIG. 6 is a plan view of the top of a mitten version of the invention, usable by either hand.
Figure 8:
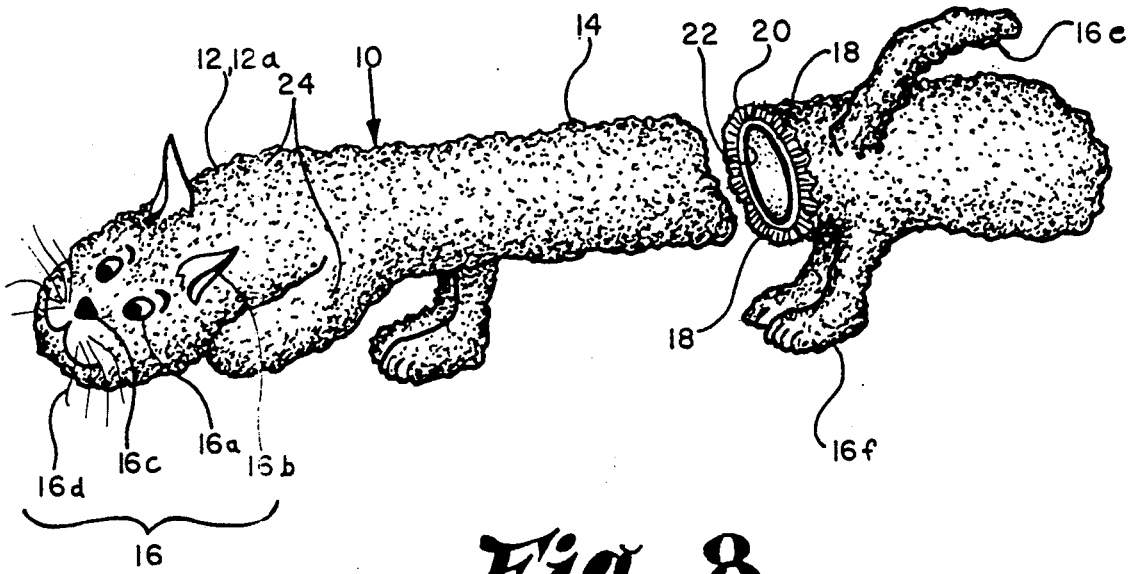
FIG. 8 is a partially cut away isometric view of an alternative embodiment of the mitten.
Figure 9:
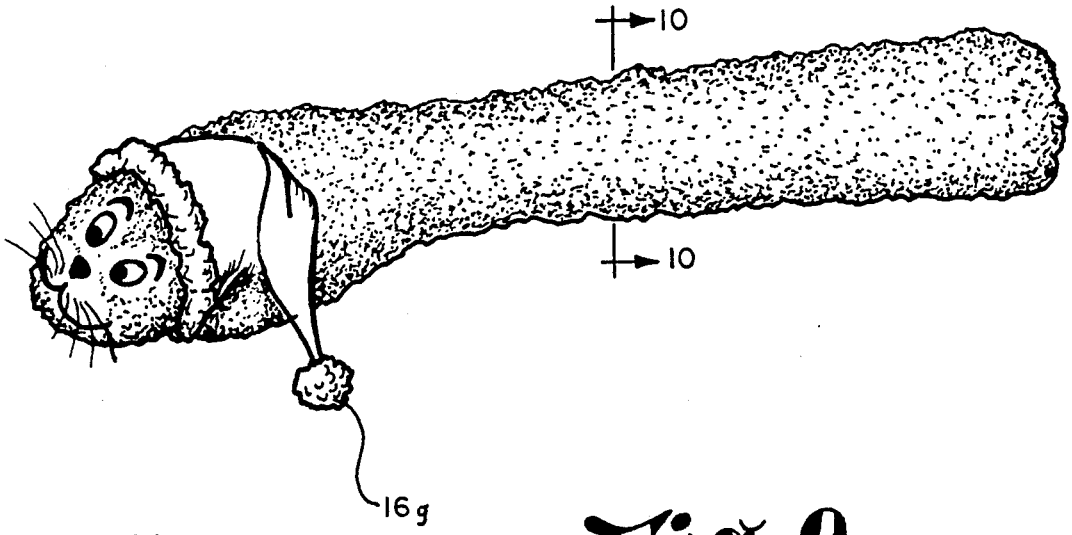
FIG. 9 is an isometric view of the kitten mitten of FIG. 1 fitted with a cap.
Figure 10:
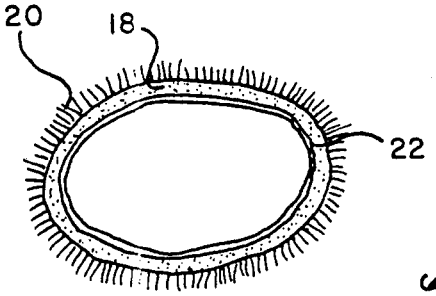
FIG. 10 is a vertical cross-sectional view of the arm portion of the invention taken along the line 10—10 of FIG. 9, and showing different layers of material used to comprise the kitten mitten.

The kitten mitten 10 is used for protecting a human hand and arm against animal inflicted related injuries. A hand covering portion 12 is adapted for receiving a human hand. An elongated arm covering portion 14, connected to and extending from the hand covering portion 12, is used for receiving an arm. The kitten mitten 10 also includes means 16 for animating the kitten mitten 10. In the preferred embodiment, the hand and arm covering portions 12, 14 are made of rawhide, heavy denim, leather, vinyl, or similar protective material 18, covered with a soft covering material 20, such as felt, and interiorly lined with rubber or some other nonporous material 22 (See FIGS. 8 and 10). The nonporous lining 22 allows the invention to be used in connection with bathing or medicinally treating the animal, but is not required. The exterior of the kitten mitten 10 can take on a variety of colors, but fluorescent colors are particularly advantageous, since some animals, cats, for example, are color blind. The kitten mitten 10 can be treated with cat nip, if desired, to make it more attractive to cats and kittens. The hand covering portion 12 includes a plurality of receiving portions 24 for receiving hand appendages, that is, thumb and fingers, for allowing the hand appendages to move independently of each other. Preferably, the hand covering portion 12 takes the form of a mitten 12*a*, as shown in FIGS. 1–3, and 8–9, and may be adapted for use by either hand, as shown in FIGS. 1, 6 and 7. Alternatively, as shown in FIGS. 4 and 5, the hand covering portion has a glove structure 12*b*. The means 16 for animating the kitten mitten 10 includes selected animal-like features affixed to the kitten mitten 10. Eyes 16*a*, ears 16*b*, nose 16*c*, and whiskers 16*d* are affixed to the hand covering portion 12 in desired locations, the kitten mitten 10 thereby being capable of performing a puppet-like function. Additional animation features can also be added, such as a tail 16*e* or legs 16*f*, which attach to the arm covering portion 14. The kitten mitten 10 can be tailored for seasonal events, such as Christmas, by adding appropriate apparel, e.g., a red Santa cap 16*g*, for Halloween by adding a witches hat, etc. Although not the preferred embodiment, all of the animation features may be removably attachable to the kitten mitten by using some mechanism such as VELCRO.

SUMMARY OF THE ACHIEVEMENTS OF THE OBJECTS OF THE INVENTION

From the foregoing, it is readily apparent that I have invented a device for protecting against injury resulting from handling or playing with an animal, such as bites or scratches, particularly injuries to the elderly and to young children; such device also provides a toy for a kitten, cat, or similar sharp toothed and/or clawed animal (i.e., raccoon, ferret, etc.), provides a human hand protective device for use when spraying, dipping, or bathing an animal, or administering medicine to the animal. The invented device can perform multiple functions, for example, as both a stand alone toy and as a puppet-like toy used in combination with a human hand.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

I claim:

1. A kitten mitten for protecting a human hand and an arm, comprising:

(a) a hand covering portion for receiving said hand and protecting against animal inflicted related injuries;

(b) an elongated arm covering portion connected to and extending from said hand covering portion for receiving said arm and protecting against animal inflicted related injuries;

(c) said hand covering portion and said elongated arm covering portion being made of a protective material selected from the group consisting of heavy denim, rawhide, leather and vinyl, said protective material having an outer surface and an inner surface;

(d) a soft outer covering, encasing said outer surface of said protective material, made or material selected from the group consisting of felt, fur, simulated fur, and terrycloth;

(e) a nonporous material lining said inner surface of said protective material; and (f) means attached to said outer covering for simulation and animation of said kitten mitten.

2. The kitten mitten as set forth in claim 1, wherein said nonporous material is rubber.

3. The kitten mitten as set forth in claim 1, wherein said hand covering portion includes a plurality of portions for receiving hand appendages, for allowing said hand appendages to move independently of each other.

4. The kitten mitten as set forth in claim 1, wherein said hand covering portion is adapted for use by either a right or left hand.

5. The kitten mitten as set forth in claim 1, wherein said means for simulation and animation of said kitten mitten includes simulated eyes on said hand covering.

6. The kitten mitten as set forth in claim 1, wherein said means for simulation and animation of said kitten mitten includes simulated ears on said hand covering.

7. The kitten mitten as set forth in claim 1, wherein said means for animating said kitten mitten includes a simulated nose on said hand covering.

8. The kitten mitten as set forth in claim 1, wherein said means for simulation and animation of said kitten mitten includes a simulated tail affixed to said arm covering.

9. The kitten mitten as set forth in claim 1, wherein said means for simulation and animation of said kitten mitten includes simulated legs affixed to and depending from said arm covering.

10. The kitten mitten as set forth in claim 1, wherein said means for simulation and animation of said kitten mitten includes a simulated Santa Claus cap on said hand covering.

11. The kitten mitten as set forth in claim 1, wherein said means simulation and animation of said kitten mitten are removably attached to said kitten mitten.

* * * * *